US005105478A

United States Patent [19]

Pyc

[11] Patent Number: 5,105,478

[45] Date of Patent: Apr. 21, 1992

[54] VENTILATED SHIRT

[76] Inventor: Chester F. Pyc, 1475 W. Big Beaver, Troy, Mich. 48084

[21] Appl. No.: 607,525

[22] Filed: Nov. 1, 1990

[51] Int. Cl.[5] ..... A41B 1/00

[52] U.S. Cl. ..... 2/115; 2/106; 2/DIG. 1

[58] Field of Search ..... 2/DIG. 1, 115, 77, 116, 2/125, 54, 53, 93, 105, 106, 108, 113, 114

[56] References Cited

U.S. PATENT DOCUMENTS

| | | | |
|---|---|---|---|
| D. 170,723 | 11/1953 | Secosky . | |
| D. 174,186 | 3/1955 | London | D3/25 |
| 179,661 | 7/1886 | Lee | 2/DIG. 1 |
| 601,489 | 3/1898 | Tim | 2/115 |
| 1,118,792 | 11/1914 | Nicholas | 2/DIG. 1 |
| 1,350,169 | 8/1920 | Mullane | 2/DIG. 1 |
| 1,360,390 | 11/1920 | Gilfillan | 2/DIG. 1 |
| 1,360,391 | 11/1920 | Gilfillan | 2/DIG. 1 |
| 1,799,572 | 4/1931 | Sweeney | 2/DIG. 1 |
| 1,973,419 | 9/1934 | Trageser | 2/115 |
| 2,079,980 | 5/1937 | Anders | 2/DIG. 1 |
| 2,114,514 | 4/1938 | York | 2/DIG. 1 |
| 2,391,535 | 12/1945 | Zelano | 2/DIG. 1 |
| 2,700,769 | 2/1955 | Polchinski | 2/DIG. 1 |
| 2,715,226 | 8/1955 | Weiner | 2/DIG. 1 |
| 2,846,687 | 8/1958 | Lippman | 2/115 |
| 3,078,699 | 2/1963 | Huntley | 2/115 |
| 3,086,215 | 4/1963 | Paola | 2/DIG. 1 |
| 3,761,962 | 10/1973 | Myers | 2/DIG. 1 |
| 3,801,987 | 4/1974 | Thompson, Jr. | 2/DIG. 1 |
| 4,513,451 | 4/1985 | Brown | 2/102 |
| 4,608,715 | 9/1986 | Miller et al. | 2/DIG. 1 |
| 4,722,099 | 2/1988 | Kratz | 2/115 |
| 4,804,351 | 2/1989 | Raml et al. | 2/DIG. 1 |

FOREIGN PATENT DOCUMENTS

| | | | |
|---|---|---|---|
| 5286 | of 1896 | United Kingdom | 2/DIG. 1 |

*Primary Examiner*—Werner H. Schroeder
*Assistant Examiner*—Amy Brooke Vanatta
*Attorney, Agent, or Firm*—Krass & Young

[57] ABSTRACT

A ventilated shirt including a shirt body and two sleeves attached thereto along shoulder seams thereof, the shirt body having a pair of elongated, mesh inserts disposed along side seams thereof, and each sleeve having a similar elongated, mesh insert disposed along sleeve seam thereof. An underarm portion of non-mesh material is disposed proximate both sides of each shoulder seam to absorb perspiration. The shirt of the present invention offers protection from damaging solar rays, and yet permits air circulation for comfort and temperature regulation.

13 Claims, 1 Drawing Sheet 10
12
14
15
16
18
20
22
24
26
28
30
32
34
36
38
40
42
44
46
48
50
52
54
56

VENTILATED SHIRT

BACKGROUND OF THE INVENTION

1. Field of the Invention

This invention relates to the field of upper body garments and, more particularly, to such a garment which shields the upper torso of the wearer from damaging sun rays, and is also ventilated for comfort.

2. Description of the Relevant Prior Art

In recent years, as more is becoming known about the damaging effects of exposing human skin to the sun's rays, people are becoming increasingly concerned with how to protect their skin from sun damage. It has been found that overexposing the skin to solar rays to the point of sunburn increase the likelihood of development of skin cancer, particularly, melanoma. In fact, subjecting the skin to even one blistering sunburn before the age of 20 can double a person's chances of developing melanoma later in life.

It is thought that increasing rates of melanoma and other skin cancers are due to a number of factors, including dissipation of the ozone layer, which tends to screen out the most harmful ultraviolet rays, and the former popularity of heavy and frequent sun bathing and sun tanning.

Not only does overexposure to the sun increase the likelihood of skin cancer, but it also causes premature aging of the skin. Years of even moderate exposure to the sun take their toll on the skin in the form of premature wrinkling and dry, leathery skin.

Recently, the population has become more conscious of the deleterious effects of overexposure to solar rays and has sought various means of protection therefrom. To that end, many people routinely apply sunblocks lotions containing paraaminobenzoic acid (PABA) to their skin before exposing it to the sun. Also, many people have adopted the custom of wearing sun shades or wide brimmed hats, and swathing their bodies in protective clothing.

Sunblock lotions, while reasonably effective, suffer from several disadvantages in that they are messy, time consuming to apply, expensive, and tend to wash off the skin due to perspiration, or immersion in water. Wearing long sleeved and long legged clothing is, of course, quite effective in protecting the skin, but such clothing tends to be hot and uncomfortable in sunny weather. Furthermore, such clothing tends to constrict movement and, thus, is not suitable for wearing while playing golf in other active sports.

Clearly there is a need for an article of clothing which shields the wearer's skin from harmful solar rays, yet is also comfortable to wear even during active pursuits.

SUMMARY OF THE INVENTION

Disclosed and claimed herein is a ventilated shirt which is particularly adapted for wear during golf, or other sports customarily played outdoors in sunny weather. This shirt includes front and back panels, each of which panel has top, bottom and opposing side edges, as well as a pair of sleeve cutouts disposed on the opposed side edges, and a neck cutout centered along the top edge. Each side seam of the front panel is joined to the corresponding side seam of the back panel for a distance adjacent the sleeve cutout.

The ventilated shirt further includes a pair of tubular sleeves joined to the front and back panels at the sleeve cutouts thereof along shoulder seams, each of said sleeves having a pair of side edges, and a wrist edge. The side edges of each sleeve are joined to each other for a distance adjacent the sleeve cutout. The joined side edges of each sleeve and the joined side edges of the front and back panel together define an underarm portion extending for a distance on either side of the sleeve cutout. The purpose of this underarm portion is to absorb perspiration.

A pair of elongated, mesh side inserts are disposed between the side edges of the front and rear panels along the unjoined portion thereof and are joined to said side edges. A similar pair of elongated, mesh sleeve inserts are disposed between the side edges of each sleeve along the unjoined portions thereof and are joined to the sleeve side edges. The side mesh inserts and the sleeve mesh inserts both allow air circulation through the sleeve and body portions of the garment, thus rendering the wearer much cooler, and more comfortable. Since the front and rear panels and the pair of sleeves are, typically, comprised of a non-mesh knitted or woven material, the garment will serve to shield the wearer's skin from harmful solar rays. Since the mesh inserts are disposed inside the sleeves and along the sides of the shirt, the sun's rays will normally be unable to penetrate the open mesh in these areas. Thus, although the shirt of the present invention is ventilated for comfort, it is able to effectively shield the wearer's skin from the sun.

In an additional aspect of the shirt of the present invention, a high, turn over collar is joined to the shirt along the neck edges of the front and rear panels. The collar is designed so that it can be turned up in the back the shield the wearer's neck from solar rays.

BRIEF DESCRIPTION OF THE DRAWINGS

The following detailed description may best be understood by reference to the following drawings in which.

DETAILED DESCRIPTION OF THE PREFERRED EMBODIMENT

Figures 1, 2:
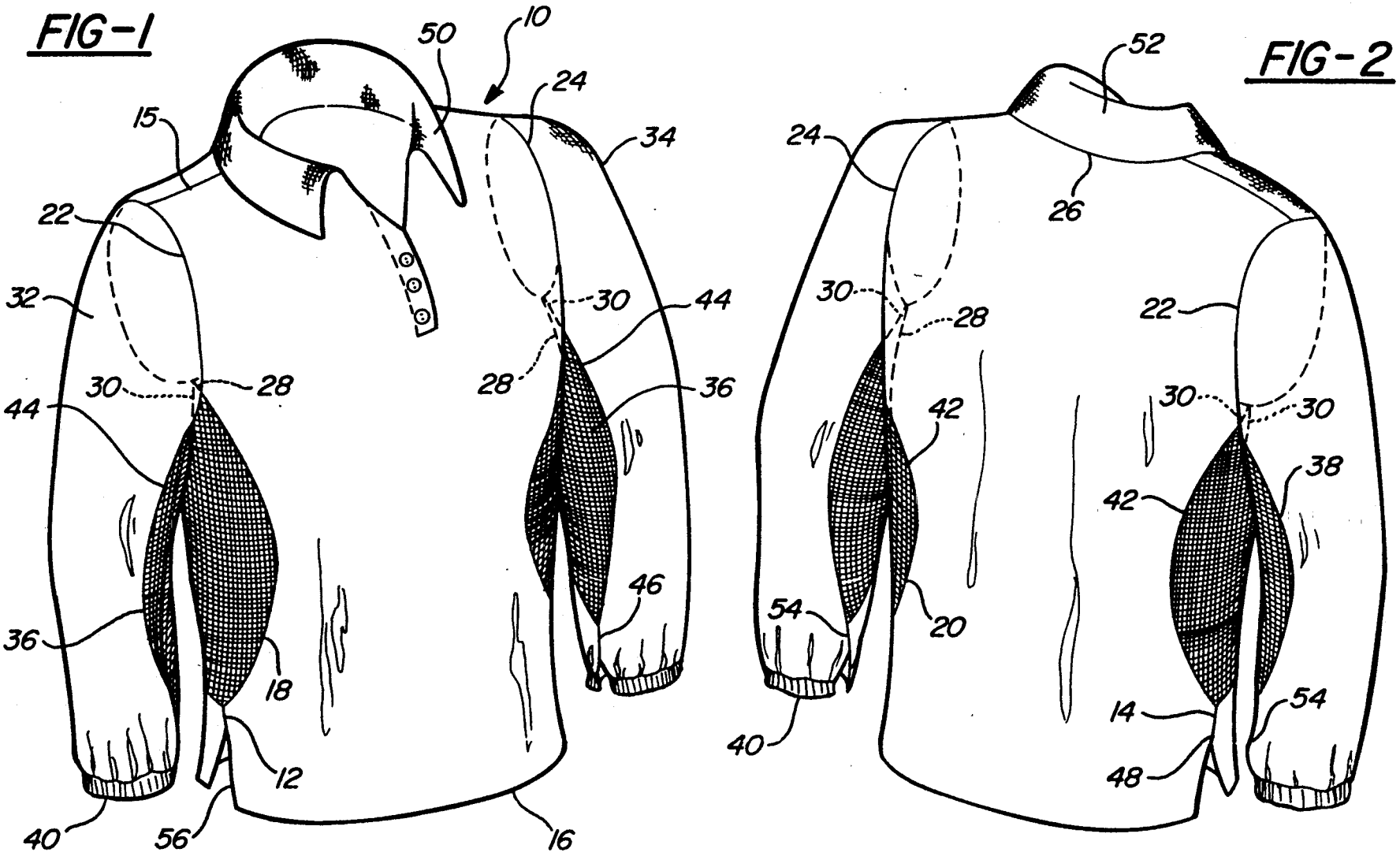
FIG. 1 is a front view, with underarm portions shown in phantom, of a ventilated shirt constructed according to the principles of the present invention.
FIG. 2 is a back view of the shirt of FIG. 1.

Throughout the following detailed description, like reference numerals are used to refer to the same element of the invention shown in multiple figures thereof. Referring now to FIGS. 1 and 2, there is depicted a ventilated shirt 10 constructed in accordance with the teachings of the present invention. The ventilated shirt 10 includes front and rear panels 12, 14, each of said front and rear panels 12, 14 including a top edge 15, a bottom edge 16, and right and left side seams 18, 20. The front and rear panels 12, 14 further include a pair of sleeve cutouts 22 formed in side seams 18, 20 so that a pair of right and left tubular sleeves 32, 34 may be attached thereto. A neck cutout 26 is formed on top edge 15 medial of sleeve cutouts 22. In the embodiment depicted in FIGS. 1 and 2, the front and rear panels 12, 14 are attached to each other along top edges 15 between sleeve cutouts 22 and neck cutout 26. However, it is to be understood that the ventilated shirt of the present invention could also be designed with raglan sleeves.

The right side seams 18 of front and rear panel 12, 14 are joined directly to each other for a distance adjacent sleeve cutout 22 to form an underarm portion 28, shown partially in phantom. In similar manner, the left side seams 20 of front and rear panels 12, 14 are joined directly to each other for a distance adjacent sleeve cutout 22 to form another underarm portion 28. The purpose of underarm portions 28 will be explained in due course.

The right and left sleeves 32, 34 each include a shoulder edge 24, front and rear sleeve edges 36,38, and a wrist edge 40. The sleeves 32,34 are attached to the sleeve cutouts 22 formed in the front and rear panels 12,14 along shoulder edges 24. Furthermore, the front and rear sleeve edges 36,38 of each sleeve 32,34 are joined directly to each other for a distance adjacent sleeve cutout 22 to form sleeve underarm portions 30, partially shown in phantom. Hence, the underarm portions 28 formed by joining the front and rear side seams 18,20 of front and rear panel 12,14 and the sleeve underarm portions 30 formed by joining front and rear sleeve edges 36,38 of each sleeve 32,34 will immediately adjoin each other on opposite sides of the juncture of sleeve cutout 22 and shoulder edge 24.

A pair of elongated, mesh side inserts 42 are disposed between each pair of front and rear side seams 18, 20 immediately below the seamed underarm portions 28. In like manner, a pair of elongated, mesh sleeve inserts 44 are disposed between each pair of front and rear sleeve edges 36,38 immediately below seamed, sleeve underarm portions 30. Side inserts 42 are disposed between the side edges 18, 20 of the front and rear panels 12, 14 along the unjoined portions thereof and are joined thereto. In like manner, sleeve inserts 44 are disposed between the sleeve edges 36,38 of left and right sleeves 32,34 along the unjoined portions thereof and are joined thereto. The purpose of mesh inserts 42,44 is to provide ventilation to the torso and arms of the shirt 10's wearer. However, and in contrast to prior art ventilated garments, the underarm areas of shirt 10 are not ventilated, but comprise the previously described underarm portions 28 and sleeve underarm portions 30 created by joining the material of which the shirt is comprised along edges 18,20, 36 and 38. Because underarm portions 28 and sleeve underarm portion 30 are not comprised of mesh material, but are comprised of the material of which the shirt 10 is formed, (typically, an absorbent, resilient, soft woven or knitted material, such as cotton, linen, wool, polyester, acrylic, nylon, other suitable synthetic yarns, and various combinations thereof), they are suitable for absorbing underarm perspiration generated by the wearer while engaging in various activities.

Other refinements may be added to the shirt 10 of the present invention. For example, each pair of front and rear side seams 18,20 of front and rear panels 12,14 may be joined directly to each other for a distance immediately adjacent and below side inserts 42 to form waist portions 48. Similarly, the front and rear sleeve edges 36,38 may be joined directly to each other for a distance immediately adjacent and below the sleeve inserts 44 to form wrist portions 46. Shirt 10 may also further comprise waist slits 56 which are formed by unjoined portions of side edges 18,20 immediately adjacent bottom edges 16. Similar wrist slits 54 may be formed in each sleeve 32,34 by unjoined portions of sleeve edges 36,38 immediately adjacent wrist edges 40. The embodiment depicted in FIGS. 1 and 2 includes both wrist portions 46 and waist portions 48, as well as wrist slits 54 and wrist slits 56. However, the shirt 10 could, alternatively, include any single one of these features, or any combination thereof desired.

Shirt 10 may further comprise a collar 50 joined to front and rear panels 12,14 along neck cutout 26 thereof. Preferably, in order to enhance the solar protective properties of the shirt 10 of the present invention, the collar 50 has a high, back portion 52 which may be flipped up to protect the back of the wearer's neck from damaging solar rays.

The shirt of the present invention may be manufactured in any particular style and color as desired without departing from the claims of the present invention. It is contemplated that the shirt will, preferably, have sleeves which are slightly longer than normal to allow for swing room if the shirt is to be used as a golf shirt. The wrist and waist slits described above also can be cut longer than shown in the embodiment depicted to allow for additional body movement and air circulation. Additionally, the shirt may comprise other features not illustrated such as wrist buttons, pockets, a front opening, etc.

In order to effectively practice the present invention, it is preferable that the side and sleeve mesh inserts 42,44 be constructed of a lightweight mesh material, preferably in a color which blends in with the color of the shirt material. It is also highly desirable that the mesh material be as flexible as the material of which the shirt is formed. Alternatively, the mesh material may be of a color or colors which contrast sharply with the color of the rest of the shirt in order to present a sporty appearance.

Thus, it can be seen that the shirt of the present invention is advantageously designed to cover as much of the torso, neck, and arms of the wearer as possible in order to block solar rays, thereby protecting the skin of the wearer from the damaging effects of sun exposure. By including the side and sleeve mesh inserts, the shirt is ventilated, thereby permitting air circulation and rendering the shirt much cooler and more comfortable than would otherwise be the case. The particular combination of protective and ventilating properties achieved by the shirt of the present invention adapts it particularly well for use in active sports, such as golf which are customarily played outdoors in hot, sunny weather.

The shirt of the present invention has been described with reference to certain exemplifications and embodiments thereof. Doubtless, while practicing the teachings of the present invention, other variations in design may occur to one skilled in the art without departing from the inventive concept claimed herein. For example, for some applications, it might be advantageous to construct the shirt with short sleeves. However, the present invention is not intended to be limited to the particular embodiments and exemplifications depicted and described herein. It is the claims appended hereto which define the scope of the present invention.

I claim:

1. A sport shirt comprising:

front and rear panels each having corresponding top, bottom and opposed side edges, said front and rear panels including sleeve cutouts formed on each side edge adjacent the top edge, and a neck cutout formed on the top edge medial of the sleeve cutouts, said front and rear corresponding side edges being joined to each other adjacent said sleeve cutouts for a distance to define a first and second continuous fabric, non-mesh underarm portion, each disposed in an underarm region of the shirt;

a pair of tubular sleeves permanently joined to the front and rear panels at the sleeve cutouts thereof, said sleeves each having a pair of side edges and a wrist edge, said pair of side edges of each sleeve being joined together adjacent the sleeve cutouts for a distance to define a first and second continuous fabric non-mesh sleeve portion thereof, said first underarm portion and sleeve portion, and said second underarm portion and sleeve portion being joined together to provide a first and second non-mesh continuous fabric region disposed in the underarm area of the shirt, said regions serving to absorb perspiration;

a pair of elongated mesh side inserts disposed between the side edges of the front and rear panels along the unjoined portions thereof and joined thereto; and a pair of elongated mesh sleeve inserts disposed between the side edges of the sleeve along the unjoined portions thereof and joined thereto.

2. The shirt of claim 1 wherein the side edges of each sleeve are further joined together at a wrist portion thereof adjacent the wrist edge thereof.

3. The shirt of claim 1 wherein the respective side edges of the front and rear panels are further joined together at a bottom portion thereof adjacent the bottom edge thereof.

4. The shirt of claim 1 further comprising a high, turn-over collar joined to the front and rear panels along the neck cutout thereof, such that the back of the collar may be flipped up to protect the neck of a wearer from sun damages.

5. The sleeve of claim 1 further comprising a sleeve slit formed in the side edge of each sleeve immediately adjacent the wrist edge thereof.

6. The shirt of claim 1 further comprising a waist slit formed in each side edge of the front and back panels immediately adjacent the bottom edges thereof.

7. The shirt of claim 1 wherein the front and rear panels are further joined together along the top edges thereof between said sleeve cutouts and said neck cutout.

8. A ventilated shirt suitable for golf or other active sports comprising:

a long sleeve shirt including a shirt body having side seams and a pair of sleeves each having an inside seam, said sleeves being permanently attached to said shirt body along shoulder seams;

a continuous fabric non-mesh, underarm portion formed by a portion of each side seam adjacent said shoulder seam and a portion of each sleeve inside seam adjacent said shoulder seam and serving to absorb perspiration;

an elongated mesh, sleeve insert disposed in the inside seam of each sleeve below said underarm portion; and an elongated mesh, side insert disposed in each side seam of the shirt body below said underarm portion.

9. The shirt of claim 8 wherein each sleeve further comprises a meshless wrist portion formed in each inside seam adjacent a wrist edge thereof.

10. The shirt of claim 9 wherein the shirt body further comprises a meshless bottom portion formed in each side seam adjacent a bottom edge thereof.

11. The shirt of claim 8 further comprising a high, turn-over collar joined to the shirt body, wherein the back of the collar may be flipped up to protect the neck of a wearer from sun damage.

12. The shirt of claim 8 further comprising a sleeve slit formed in the inside edge of each sleeve immediately adjacent a wrist edge thereof.

13. The shirt of claim 8 further comprising waist slits formed in the side seams of the shirt body immediately adjacent a bottom edge thereof.

* * * * *